US005604510A

United States Patent [19]

Blanchard

[11] Patent Number: 5,604,510

[45] Date of Patent: Feb. 18, 1997

[54] LIQUID CRYSTAL DISPLAY DRIVE WITH VOLTAGE TRANSLATION

[75] Inventor: Randall D. Blanchard, San Diego, Calif.

[73] Assignee: Palomar Technologies Corporation, Carlsbad, Calif.

[21] Appl. No.: 370,754

[22] Filed: Jan. 10, 1995

[51] Int. Cl.[6] ..... G09G 3/36

[52] U.S. Cl. ..... 345/98; 345/63; 345/89; 345/90; 345/212

[58] Field of Search ..... 345/209, 208, 345/212, 98, 101, 152, 174, 89, 94, 95, 96, 63, 77, 90, 92

[56] References Cited

U.S. PATENT DOCUMENTS

| | | | |
|---|---|---|---|
| 3,776,615 | 12/1973 | Tsukamoto et al. | 345/94 |
| 4,109,241 | 8/1978 | Shanks | 345/95 |
| 4,870,396 | 9/1989 | Shields | 345/90 |
| 4,901,066 | 2/1990 | Kobayashi et al. | 345/94 |
| 5,088,806 | 2/1992 | McCartney et al. | 345/101 |
| 5,119,085 | 6/1992 | Yamazaki | 345/209 |
| 5,247,376 | 9/1993 | Wakai | 345/95 |
| 5,298,915 | 3/1994 | Bassetti, Jr. | 345/152 |
| 5,367,314 | 11/1994 | Okada et al. | 345/98 |
| 5,410,329 | 4/1995 | Tagawa et al. | 345/174 |
| 5,414,443 | 5/1995 | Kanatani et al. | 345/89 |
| 5,434,599 | 7/1995 | Hirai et al. | 345/212 |

*Primary Examiner*—Kee M. Tung
*Assistant Examiner*—Martin Loui
*Attorney, Agent, or Firm*—Rodney F. Brown

[57] ABSTRACT

The drive voltage ($V_{DATA}$–$V_{REF}$) across an active matrix liquid crystal display module (24) is reversed on alternate frames or alternate lines by using a fixed voltage level ($V_{REF}$) at one side of the LCD module and shifting the level of a base component ($V_{BASE}$) on the other side of the module between higher and lower voltage levels that are respectively higher than the fixed reference level and lower than the fixed reference level. All voltages have the same polarity so that polarity shifting of any applied voltage is not required. An intensity level component from a digital to analog converter (40*a*), controlled by a digital input code (41), is combined with the base component in the same sense in alternate frames, but with the digital input code inverted in alternate frames.

9 Claims, 3 Drawing Sheets

LIQUID CRYSTAL DISPLAY DRIVE WITH VOLTAGE TRANSLATION

BACKGROUND OF THE INVENTION

1. Field of the Invention

The present invention relates to liquid crystal active matrix displays, and more particularly concerns a liquid crystal display module drive voltage that is periodically reversed without the use of large numbers of switching amplifiers.

2. Description of Related Art

Liquid crystal display devices require repetitively reversed voltage to be applied across the counter electrodes that are provided on opposite sides of the multi-layer liquid crystal display (LCD) module. For the active matrix LCD, shades of grey are produced by applying different levels of drive voltage to achieve a desired intensity of the image. The different voltage levels are provided by digital to analog converters (DAC's). Because of the requirement for alternating polarity drive signals, which provide a zero average voltage across the liquid crystal material, the drive signal level, which includes the analog output of the DAC, is usually reversed in alternate lines and/or in alternate frames by use of an amplifier that is switched between inverting and noninverting modes. If a design requires 64 DAC's, for example, then 64 such switching amplifiers are needed to perform the inversion function. Such switching amplifiers are more complex, more expensive, subject to undesirable voltage drift and require closely matching tolerances. At least partly because the switching function adds capacitance to the amplifier circuit, the switching amplifier must be made to operate at higher speed to accommodate the slowing effect of the capacitance. Temperature compensation is highly desirable for LCD's because of the sensitivity of the liquid crystal material operation to temperature variation. With the use of an amplifier that switches between inverting and noninverting modes, temperature tracking and temperature compensation are more difficult.

Accordingly, it is an object of the present invention to provide a periodically reversing voltage drive for a liquid crystal active matrix LCD that avoids or minimizes above mentioned problems.

SUMMARY OF THE INVENTION

In carrying out principles of the present invention in accordance with a preferred embodiment thereof, a drive circuit for a liquid crystal display device includes means for establishing a fixed reference potential on one side of the device and applying to the other side of the device a data signal that is switched between a high level signal and a low level signal, wherein all of the signals are of the same polarity and wherein the reference signal has a voltage level of a value between the voltage values of the high and low level signals. The data signals include a grey level component derived from a digital to analog converter that has an output voltage level controlled by a digital to analog converter input code. The input code to the converters is inverted in alternate time intervals.

DESCRIPTION OF THE PREFERRED EMBODIMENTS

Figure 1:
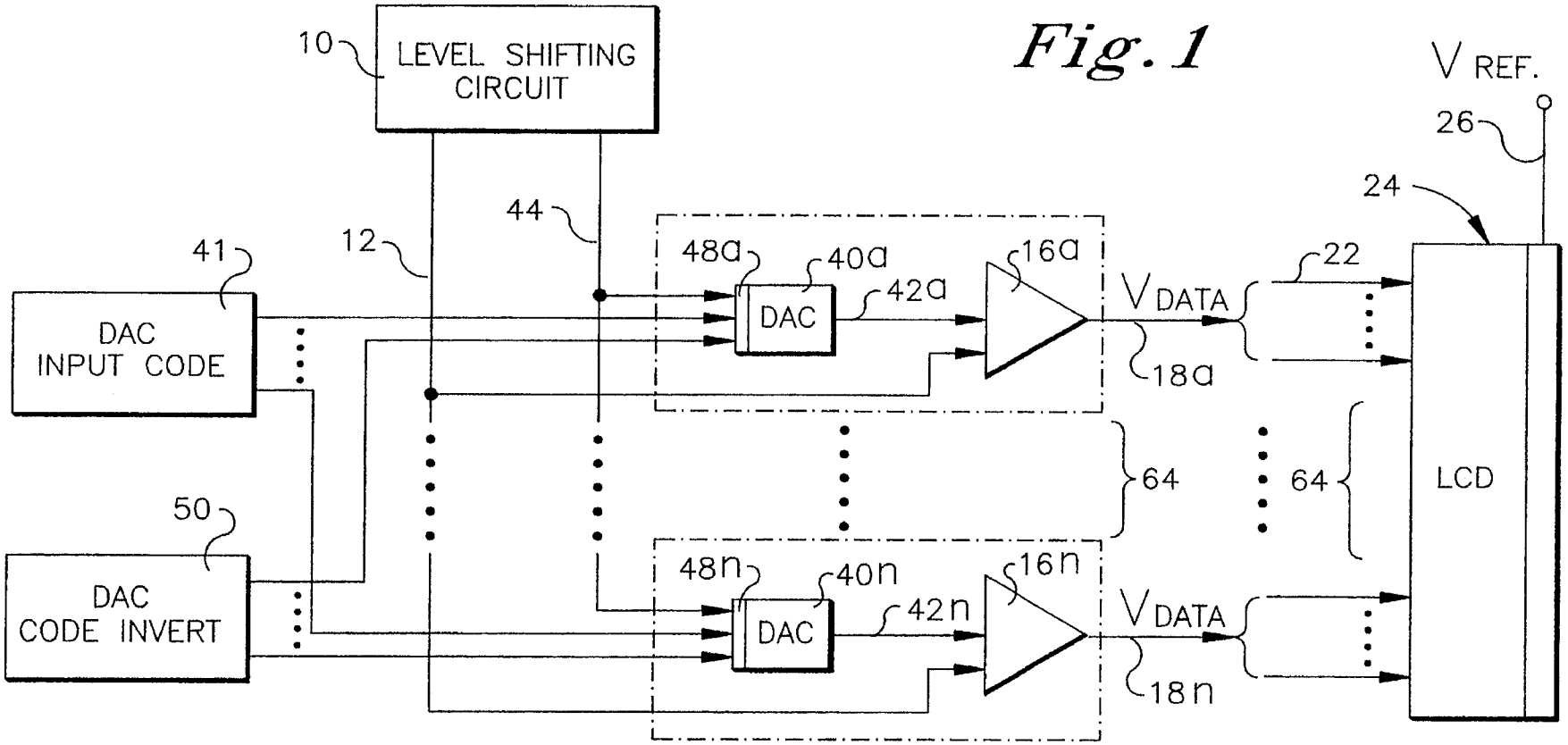
FIG. 1 is a functional block diagram of a liquid crystal active matrix display device having a drive circuit that embodies principles of the present invention.
Figure 4:
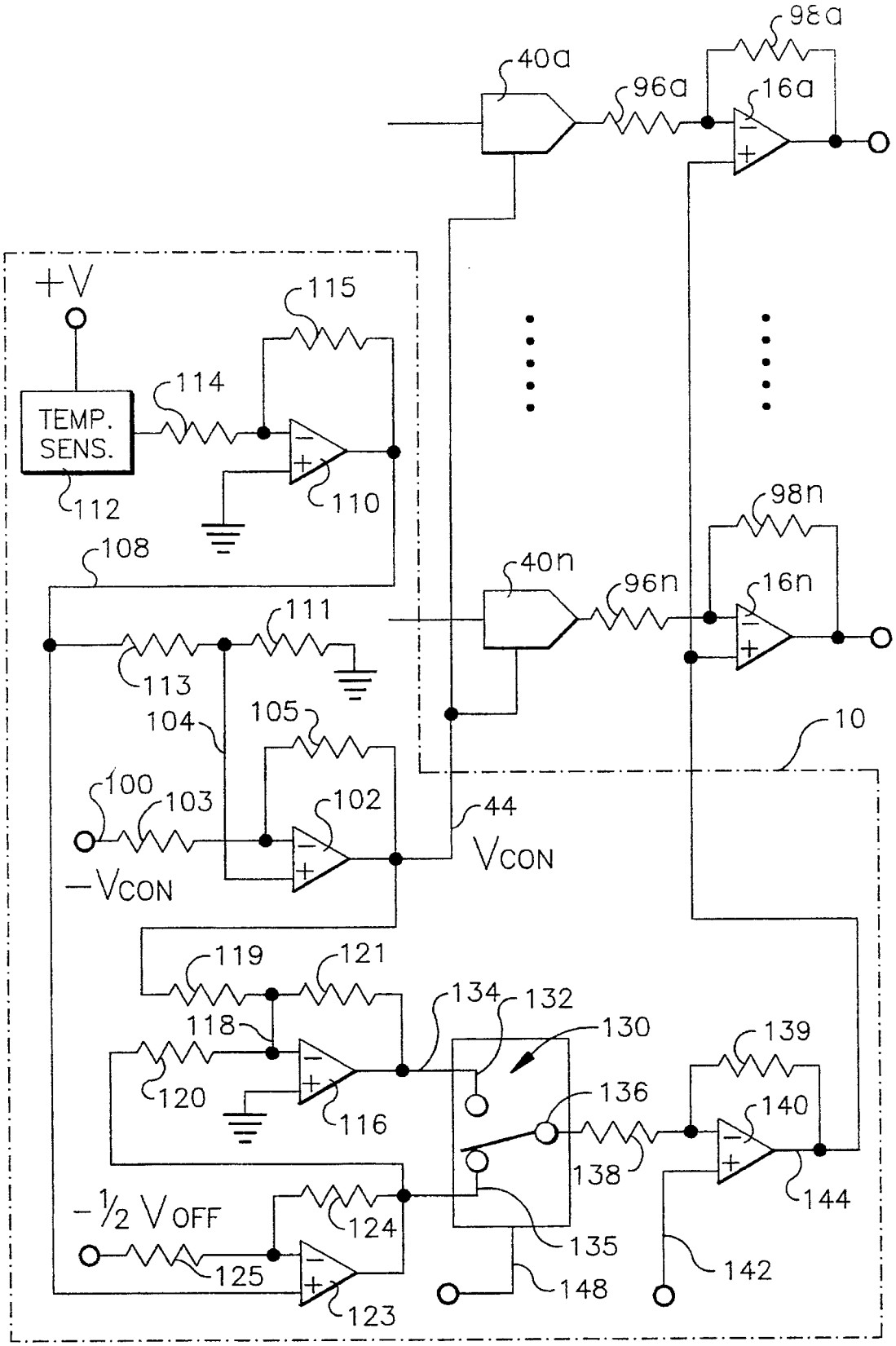
FIG. 4 is a circuit diagram of the level shifting drive circuit shown in the block diagram of FIG. 1, together with certain parts of the block diagram of FIG. 1.

Referring now to FIG. 1, a level shifting or switching drive circuit 10, details of which are illustrated in FIG. 4 and will be described below, provides on an output line 12 a drive signal $V_{BASE}$ that alternates between two voltage levels $V_{+MIN}$ and $V_{-MIN}$, such as for example, +13 volts and +6 volts in a specific embodiment, in successive time intervals. The voltage on line 12 is fed to the non-inverting input of each of a group (sixty four in this exemplary embodiment) of summing amplifiers 16*a*–16*n*. The outputs of each of the summing amplifiers provides the LCD module drive signal $V_{DATA}$ on each of lines 18*a*–18*n*. Each drive signal is fed through a plurality of lines 22 that apply the data signal on lines 18*a*–18*n* to a group (eight in this exemplary embodiment) of scanned columns of the active matrix LCD module, generally indicated at 24. To the common electrode plane on the other side of the LCD module 24 is applied a fixed reference voltage (+8/5 volts in a specific embodiment) via a line 26.

In order to control intensity of light transmitted through the LCD module, that is, to control the grey scale of the image, the level of voltage provided at the first input of each summing amplifier 16 is combined with the output of an associated one of a group of digital to analog converters (DAC) 40*a*–40*n*. Each of DAC's 40*a*–40*n* receives a range control signal $V_{CON}$ on a line 44 from the level shifting circuit 10. A DAC input code (a digital code of between 0 and 255, for example) provides a digital input to each DAC for control of the magnitude of its analog output on lines 42*a*–42*n*. $V_{CON}$ on input line 44 controls the range of output voltages of the DAC. For purposes to be described below, at the input of each DAC is provided an inverting circuit 48*a*–48*n* in the form of a standard one's complement inversion circuit that is triggered to operate at alternate time intervals by operation of a code inverting trigger 50 that is synchronized with the switching of the level shifting circuit 10. The DAC's 40*a*–40*n* are conventional circuits and each may be one converter of the four converters provided on a single CMOS chip by Analog Devices as a Model AD7225 Quad 8-Bit DAC.

For a liquid crystal display having a matrix of 512 lines, for example, the arrangement described above in which 8 rows are driven by the $V_{DATA}$ signal on each of lines 18*a*–18*n*, is repeated 64 times, as indicated in FIG. 1, which shows a group of identical arrangements of DAC's and drive amplifiers. However all 64 DAC's and all 64 drive amplifiers are driven in common by a single level shifting circuit 10. All DAC's are connected in common to the output $V_{CON}$ output on line 44 of the single level shifting circuit and to the code inversion trigger signal provided by single inversion trigger 50. The input code circuit 41 provides a succession of different digital input codes so as to send a code unique to each pixel at the appropriate time in the matrix scan.

The arrangement shown in FIG. 1 may operate either the single LCD module of a monochrome system or a single one of the three LCD color component modules of a full color system.

In a full color liquid crystal display system, as in a liquid crystal color projector, three monochrome active matrix LCD modules are combined in a manner well known in the art, with each of the LCD modules being driven by a different one of the throe primary colors, red, green and blue. The digital to analog converters for each of the three LCD modules provides intensity variation for each of the red, green and blue components of the full color signal. Thus there are three substantially identical arrangements of the circuitry shown in FIG. 1 for a full color system.

The arrangement shown in FIG. 1 provides for regular, repetitive reversal of the voltage difference across the LCD module, including the required intensity variation component, without changing polarity of the voltages and without use of polarity changing or inverting amplifiers. A single level shifting circuit provides the base voltage $V_{BASE}$ to all 512 lines of the LCD with shifted magnitude but with unchanged polarity.

Figure 2:
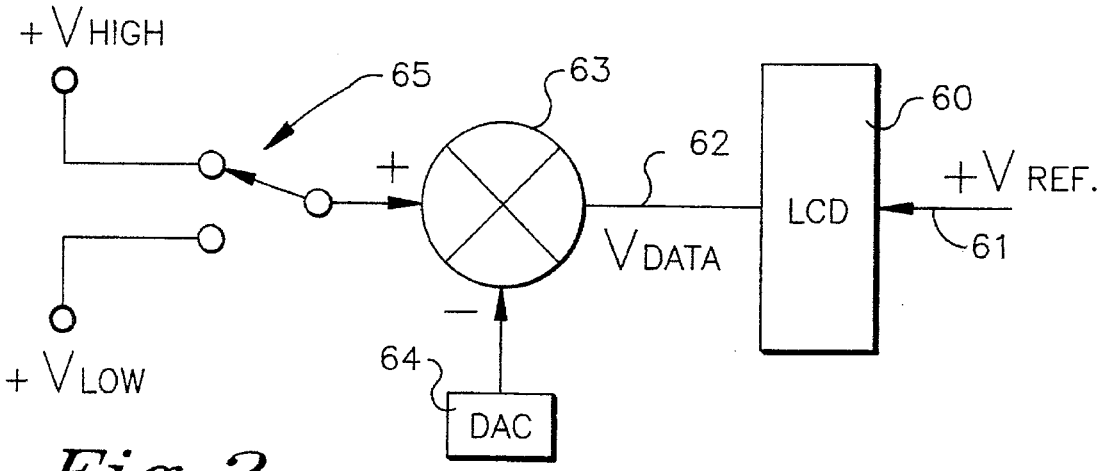
FIG. 2 is a greatly simplified illustration of the voltage translation.

The level shifting voltage reversal of the arrangement shown in FIG. 1 is illustrated for purposes of explanation in the greatly simplified sketch of FIG. 2, in which an active matrix LCD module 60 is provided on one side with a fixed positive voltage, such as $+V_{REF}$, via a line 61, and on the other side with a positive voltage $V_{DATA}$ on a line 62. $V_{DATA}$ is the difference between a level shifted voltage, $V_{BASE}$, applied to a plus input of a difference circuit 63, and a DAC output voltage applied to the minus input of the difference circuit from a DAC 64. $V_{BASE}$ is provided at the output of a switch 65 as a level shifted voltage that varies between a value $+V_{HIGH}$ that is greater than $+V_{REF}$ and a lower value $+V_{LOW}$ that is smaller than $+V_{REF}$. The high and low voltages are applied to the switch from input terminals which are connected to suitable voltage sources. $+V_{HIGH}$ is always positive and greater than $V_{REF}$. $+V_{LOW}$ is always positive but less than $V_{REF}$. Thus, it will be seen that the polarities of all of the voltages are the same and that a reversal of current flow direction is obtained by utilizing a fixed reference voltage on one side of the liquid crystal display that is intermediate the voltage levels of the high and low voltages successively applied to the other side of the display. It may be noted that the DAC voltage is subtracted from the $V_{BASE}$ voltage from the switch in both switch positions, e.g. in all time intervals.

Figure 3:
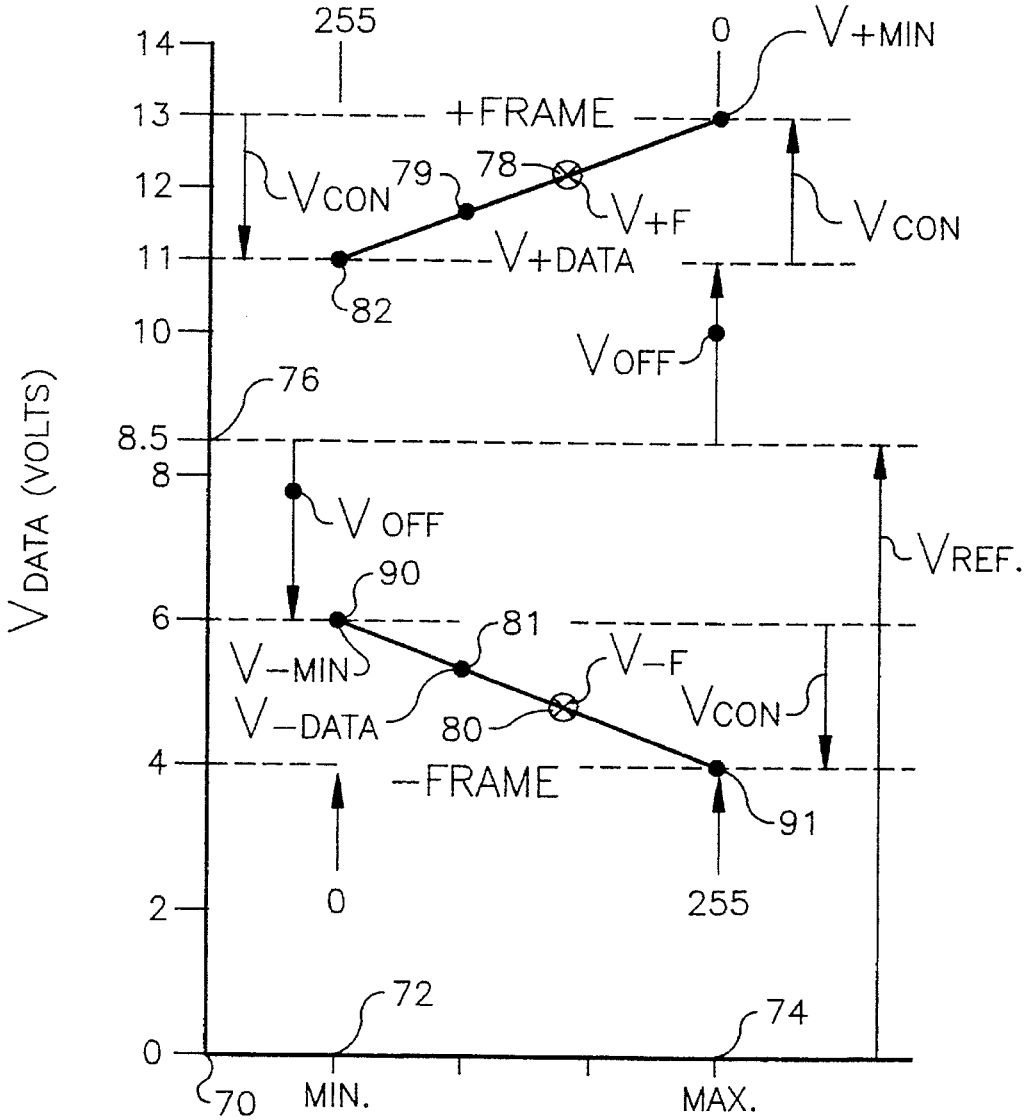
FIG. 3 is a graph showing variation of transmission through the liquid crystal display device with variation of drive signal.

FIG. 3 is a graph that illustrates a specific example of the relation of the various voltages applied in successive time intervals in which voltage difference across the active matrix LCD module is reversed. It is assumed for purposes of discussion of FIG. 3 that voltage is reversed from frame to frame, that is, a frame in which a voltage on the controlled side of the device is higher than the fixed reference voltage on the other side of the device is followed by a frame in which the voltage on the controlled side of the device is lower than the reference voltage on the second side of the device, and visa versa, repetitively. In carrying out principles of the present invention, voltages may be reversed in alternate frames or on alternate lines of each frame. In one frame, current in all odd lines may be caused to flow in one direction and current in all even lines caused to flow in the opposite direction, and in the next frame current in the odd lines may be made to flow in the opposite direction and current in the even lines made to flow in the first direction. It is only necessary that the voltage and current direction be reversed in successive time intervals. Conveniently these time intervals are alternate frames or alternate lines. For purposes of exposition, the following description embodies a switching in successive frames termed a minus frame and a plus frame.

In the specific example of FIG. 3 all representations greater than 8.5 volts relate to the so called plus frame (in which voltage is greater on the controlled side of the LCD than on its fixed side). All representations in FIG. 3 less than 8.5 volts relate to the minus frame (in which voltage on the controlled side of the LCD is less than voltage on its fixed side).

The graph of FIG. 3 shows an abscissa in which magnitude or intensity of light transmission increases from the left, at the origin of the graph, point 70, toward the right, passing through a point 72 in which the display is off, e.g. dark or minimum transmission, and thence to a point 74 as transmission increases, at which point transmission is of maximum intensity and the display is considered to be full on. Along the ordinate are plotted positive voltage levels, with a reference voltage shown at point 76 of 8.5 volts. In the example discussed herein 8.5 volts is the reference voltage, $V_{REF}$. During the plus frame, voltage $V_{DATA}$ on line 18 of FIG. 1 varies between a level of +13 volts and a level of +11 volts, as shown by the straight line 79. In the succeeding frame, which is termed the "minus frame", voltage varies between a level of +6 volts to a level of +4 volts, as shown by straight line 81. These are the voltages $V_{DATA}$ on line 18 of FIG. 1. In the described arrangement, in the plus frame, the display is full on at a voltage of +13 volts and is off at a voltage of +11 volts ($V_{OFF}$), on the controlled side. In the minus frame the display is full on at a voltage of +4 volts and is off at a voltage of +6 volts on the controlled side. All voltages are positive in this example. In the plus frame a reduced transmission may be provided at some exemplary intermediate point 78, at which a voltage of $V_{+F}$ is provided. In the minus frame the same magnitude of transmission is provided at the corresponding intermediate point 80, at a voltage of $V_{-F}$.

It is important to note that the voltages indicated include both the base level compound of alternately high and low levels, and the component provided by the output of the DAC's, and further, that the digital input code to the DAC is inverted in the plus frame. This input code is inverted to allow the DAC output to be subtracted from the level shifted base voltage in both plus and minus frames, allowing the same combining circuit to be used in both plus and minus frames. Thus a zero DAC input code at point 90 produces the minimum transmission, or an off condition of the display in the minus frame. This is provided for the minus frame by a zero DAC input code (without inversion). However, for the succeeding plus frame the one's complement or inverted DAC input for the off condition is 255, point 82 in FIG. 3. Similarly, when the noninverted digital code (in minus frame) has a value of 255, for providing maximum transmission, as at point 91, the inverted code for the plus frame is 0, as indicated at point 84 in the plus frame. The DAC has a full range of 2 volts in this example, which is established by the control voltage $V_{CON}$.

In the minus frame, with minimum transmission, the voltage $V_{OFF}$ at point 90 (+6 volts) is less than the +8.5 volt reference voltage (on the other side of the LCD) by 2.5 volts. The DAC input code is O and the DAC output is 1. With the input code of the DAC at 255, as at point 91, the voltage in the minus frame has decreased by the full range $V_{CON}$ of the converter. Thus, over its full range the DAC output varies in the minus frame from +6 volts to +4 volts. Assuming the DAC code at arbitrary point 80 ($V_{-F}$ in the minus frame) is 178, a voltage of 3.9 volts is provided across the LCD. This value of 3.9 volts is determined as follows: a digital input code of 178 determined as follows: a digital input code of 178 provides a DAC voltage 80 of 1.4

$$\left(1.4=\frac{178\times V_{CON}}{255}\right).$$

Where $V_{CON}$=2.

Thus the voltage at point 80 is 8.5–2.5–1.4, which is equal to an absolute voltage above zero of +4.6 at point 80. With a reference voltage of 8.5 on the fixed side of the LCD module the voltage across the module is 3.9 volts (for a DAC input code of 178) for the minus frame.

For the plus frame, the intermediate value $V_{+F}$ at a point 78 of transmission, corresponding to point 80 of the minus frame, is produced by translating the drive voltage component (not inverting it). In the plus frame the DAC output increases as the inverted DAC input code decreases from 255 to 0 (e.g. as the non-inverted input code increases). Effectively, inversion of the digital input code inverts the DAC output. The minimum voltage ($V_{+MIN}$) in the plus frame is +13 volts. This is equal to the reference voltage 8.5 plus the 2.5 volt $V_{OFF}$ plus the 2.0 value $V_{CON}$. As noted above, the required DAC input code is inverted in the plus frame so that for the point 78 $V_{+F}$ that has equivalent transmission to transmission at $V_{-F}$ in the minus frame, the inverted input code is 77 (255–178). This produces an absolute value of 12.4 volts for $V_{+F}$ (8.5+2.5+2–0.6), or a voltage of 3.9 volts across the LCD module, where $V_{OFF}$ is 2.5 V, $V_{CON}$ is 2 V and $$0.6=\frac{77\times 2}{255}\ ).$$

Thus the same level of intensity is provided in the minus frame with a DAC input code of 178 as is provided with a DAC input code of 178 (inverted to 77) in the plus frame.

The discussion of FIG. 3 may be summarized as follows: The voltage $V_{DATA}$ applied to the controlled side of the LCD module has two components, a fixed base component that is switched between high and low levels and a variable component that is provided by the output of the DAC. In the exemplary embodiment the fixed base component is switched between a low voltage of +6 volts for the minus frame and a higher voltage of +13 volts for the minus frame. The reference voltage on the other side of the LCD is a constant 8.5 volts, so that the polarity of the potential difference across the LCD modules switches between minus and plus frames.

For the minus frame minimum transmission voltage at point 90 is 6 volts. If the DAC input code is 0 upon switching to the minus frame, $V_{-F}$ is +6 volts, which produces a voltage of 2.5 volts across the LCD, with the fixed reference voltage side higher than the controlled side. As the DAC input code increases toward 255 the DAC output component increases toward 2 volts. The circuit subtracts (subtraction occurs in both minus and plus frames) the variable DAC component from the fixed base component so that the voltage on the controlled side decreases from 6 toward 4 as the DAC input code increases to provide a voltage across the LCD module at full on of 8.5–4=4.5 volts.

For the plus frame the base component is switched to +13 volts, and for this frame the DAC input code is inverted. (Of course the DAC input code may be inverted in either the plus or minus frame, but not both.) Inversion of the DAC input code in this frame allows the converter output to be subtracted from the base component in this plus frame and avoids the need for changing between subtraction and addition when combining base and variable components, and when changing from one frame (or other time interval) to the next. Accordingly, if the base voltage component is switched to 13 volts with a non-inverted DAC input code of 0, the inverted DAC input code is 255, to provide a DAC output of 2 volts. Thus, at a non-inverted DAC input code of 0 in the plus frame (with the inverted DAC input at 255), minimum transmission voltage at point 82 is 13–2 or 11 volts. Therefore, at 0 DAC input (non-inverted) at point 82, the voltage across the LCD module is 11–8.5=2.5 volts, which is the same as the voltage across the LCD module at point 90 in the minus frame. But in this plus frame the controlled side voltage is higher than the reference side voltage.

As the non-inverted DAC input increases from 0 toward 255 in the positive frame, the inverted DAC input code decreases from 255 toward 0. Because the DAC output is still subtracted from the fixed level component, the difference between the base component and the decreasing DAC output effectively increases the $V_{DATA}$ voltage on the controlled side of the LCD module so that the voltage difference across the LCD module becomes greater as the non-inverted DAC input code becomes greater. At full on, where the non-inverted DAC input code is 255 and the inverted DAC input code is 0, the voltage across the LCD module (in this positive frame) is (13–0)–8.5=4.5, which is the same as the full on voltage in the minus frame. But, in this plus frame the controlled side voltage is higher than the fixed side voltage. Thus the base voltage is switched, in this example, between 6 volts for the minus frame and 13 volts for the plus frame, with the DAC input code inverted for the plus frame.

A circuit for implementing the combining of switched level base voltages and the converter outputs, together with temperature compensation, is illustrated in FIG. 4. The circuit of FIG. 4 is the circuit indicated as level shifting circuit 10 of FIG. 1. FIG. 4 also shows, outside of dotted box 10, the DAC's **40*a*–40*n* and drive amplifiers 16*a*–16*n*. The output of DAC's 40*a*–40*n* is provided to the drive amplifiers 16*a*–16*n* via resistors 96*a*–96*n*. Additional input is provided to the drive amplifiers 16*a*–16*n* via feedback resistors 98*a*–98*n*. A digital to analog converter control voltage ($V_{CON}$), provided on an input line 100, is fed to the minus input of a differential amplifier 102 via resistor 103, which receives at its plus input on a line 104 a temperature compensating input (½ $V_{DACTC}$) on a line 108 from the output of a temperature amplifier 110, which in turn receives the output of a temperature sensor 112 via resistor 114. Additional input is provided to the temperature amplifier 110 via feedback resistor 115 and additional input is provided to the differential amplifier 102 via feedback resistor 105**.

The temperature compensating signal on line 108 is divided by two equal value voltage dividing resisters 11,113 to be ½ $V_{CONTC}$, which is one-half of the temperature compensation voltage required for compensating the DAC. In this particular example the voltage $V_{CON}$ on line 100 is –2 volts, and the output of amplifier 102 on line 44 is the voltage $V_{CON}$ shown in FIGS. 1 and 3.

A second differential amplifier 116 has its minus input on a line 118 provided from an input summing network formed of resisters 119,120, and a feedback resister 121. Resistors 120 and 121 are equal to each other and each is one-half the resistance of resistor 119 to provide for a doubling of the voltage applied to the minus terminal of amplifier 116. The voltage applied via resistor 120 and the output of an amplifier 123 to the input terminal of amplifier 116 is –½$V_{OFF}$, which is one-half the voltage $V_{OFF}$ shown in FIG. 3. This voltage –½$V_{OFF}$, is applied via a resistor 125 to the minus input terminal of amplifier 123. Additional input is provided to amplifier 123 via feedback resistor 124. In a particular example the voltage $-\frac{1}{2}V_{OFF}$ is −1.25 volts. The plus input of amplifier 123 receives a signal from the output of temperature amplifier 110 on line 108. The $V_{OFF}$ voltage is temperature compensated by a voltage ($\frac{1}{4}V_{OFFTC}$) on line 108, which is one-quarter of the compensation voltage needed for the LCD module at its off condition. In a specific example, the output temperature sensor amplifier 110 is −2.5 MV per degree C. This output is fed to the plus input of amplifier 116. A −1.25 MV per degree C is fed to the plus input of amplifier 102. The output of amplifier 102, the temperature compensated $V_{CON}$ voltage, is fed to each of the sixty-four DAC's 40*a*–40*n*.

A switch 130 has a first input terminal 132 receiving the voltage $\frac{1}{2}V_{OFF}$ on a line 134 from the output of amplifier 116. $\frac{1}{2}V_{OFF}$ is also fed to a second input terminal 135 of switch 130. The switch output, at a terminal 136, is provided via a resistor 138 to the minus input of an operational amplifier 140, which receives on a line 142, at its plus input, a voltage $\frac{1}{4}V_{REF}$, which is one-quarter of the 8.5 volt reference voltage or 2.125 volts in this specific examples. Additional input is provided to the operational amplifier 140 via feedback resistor 139.

Amplifier 140 inverts the voltage at terminal 136 of switch 130. With switch 130 in the illustrated solid line position (for the minus frame), amplifier 140 provides on its output line 144 the voltage $\frac{1}{2}V_{-MIN}$, which is $\frac{1}{2}V_{REF}-\frac{1}{2}V_{OFF}$. Amplifier 140 is configured to double its plus input. This is the $V_{BASE}$ output indicated on line 12 at the output of circuit 10 of FIG. 1. This voltage on line 144 is 3 volts in this particular example (4.25–1.25).

As mentioned above, the temperature correction $V_{CONTC}$ for the DAC may be set at approximately −1.25 millivolts per degree C, and the temperature correction $V_{OFFTC}$ for the offset level ($V_{OFF}$) of the LCD module may be set at −2.5 millivolts per degree C.

Ignoring the temperature correction for purposes of the present explanation, the −2 volt input $-V_{CON}$ on line 100 appears as a +2 volt output of the circuit on line 44 to control the range of all 64 of the DAC's 40*a*–40*n*. Switch 130 is toggled by a level toggle signal on a line 148. Accordingly, when in the illustrated solid line position, the switch provides an output of 1.25 volts for the minus frame. The $\frac{1}{4}V_{REF}$ of 2.125 volts on line 142 is doubled by amplifier 140 and combined with the −1.25 volt output of switch terminal 135 to provide an output of 3 volts on line 144. The 3 volt signal in the minus frame is doubled by each of amplifiers 16*a*–16*n* and combined in these amplifiers with the individual DAC signals from DAC's 40*a*–40*n*. The outputs of amplifiers 40*a*–40*n* form the voltage $V_{-F}$ shown in FIG. 3, e.g. the controlled side voltage $V_{DATA}$.

For the plus frame switch 130 is toggled to the dotted line position shown in FIG. 4 to receive the $-\frac{1}{2}V_{OFF}$ of −1.25 volts from amplifier 116.

In this plus frame, $V_{CON}$, 2 volts, is divided by two in resistor dividing network 119,121 of amplifier 116, which combines $\frac{1}{2}V_{CON}$ with the $\frac{1}{2}V_{OFF}$ to provide an inverted output $-\frac{1}{2}V_{OFF}-\frac{1}{2}V_{CON}$ (=−2.25 volts) to switch terminal 132. This voltage is fed to the minus terminal of operational amplifier 140, which combines it with the doubled value of $\frac{1}{4}V_{REF}$ of 2.125 volts. The fixed higher component $\frac{1}{2}V_{+MIN}$ of 6.5 V ($\frac{1}{2}V_{+MIN}=\frac{1}{2}V_{REF}+\frac{1}{2}V_{OFF}+\frac{1}{2}V_{CON}$) is provided on circuit output line 144 to the plus input of all drive amplifiers 16*a*–16*n*. The latter combine the DAC outputs to their minus inputs with the doubled $\frac{1}{2}V_{+MIN}$ of 13 volts. In the particular example used herein the DAC output for an exemplary input code is 30 0.6 V which, when differentially combined with +13 volts provides 12.4 volts on the controlled side of the LCD module to produce 3.9 volts across the LCD, but in a sense opposite that produced in the minus frame.

In summary, for the minus frame the circuit 10 provides an input to amplifiers 16*a*–16*n* of $\frac{1}{2}V_{-MIN}=\frac{1}{2}V_{REF}-\frac{1}{2}V_{OFF}$. For the plus frame the input to amplifiers 16*a*–16*n* is $\frac{1}{2}V_{+MIN}=\frac{1}{2}V_{REF}+\frac{1}{2}V_{OFF}+\frac{1}{2}V_{CON}$. The output of temperature sensor amplifier 110 is −2.5 MV per degree C, which is one quarter of the desired LCD module temperature compensation. This is doubled in amplifier 123 and doubled again in each of amplifiers 16*a*–16*n*, to provide temperature compensation to the LCD module of −10 MV per degree C. One-half of the sensor output at the center of resistive voltage divider 111,113, provides a $V_{CON}$ temperature correction of −1.25 MV per degree C to the input of amplifier 102 which doubles this and combines it with $V_{CON}$ for a temperature correction component of −2.5 MV per degree C. These are values chosen for a specific liquid crystal material and may be changed for different materials.

There have been described apparatus and methods for driving an active matrix LCD module with varying intensity level and repetitively reversed drive voltages, employing unique simplified and improved shifted level voltages, all of like polarity, thereby simplifying the circuitry and decreasing its costs.

What is claimed is:

1. A drive circuit for a liquid crystal display device in which drive signals of repetitively alternate polarity are applied across the device during successive time intervals, said drive circuit comprising:

means for establishing reference signal ($V_{REF}$) of fixed reference voltage continuously applied to one side of the device, means for applying to the other side of the device a data signal ($V_{DATA}$) comprising a fixed magnitude component that is switched between a high level voltage and a low level voltage, and a variable magnitude component that is combined with said fixed magnitude component in said successive time intervals, wherein all of said voltages maintain the same fixed polarity, and wherein said reference voltage has a magnitude between magnitudes of said high and low level voltages, a control code for controlling the magnitude of said variable magnitude component; and means for inverting said control code during alternate successive time intervals.

2. The drive circuit of claim 1 including a control signal generator for producing a variable control voltage, means for inverting said variable control voltage during alternate successive time intervals, and means for combining said high and low level voltages.

3. A drive circuit for a liquid crystal display device in which drive signals of repetitively alternate polarity are applied across the device during successive time intervals, said drive circuit comprising:

means for establishing reference signal ($V_{REF}$) of fixed reference voltage continuously applied to one side of the device, means for applying to the other side of the device a data signal ($V_{DATA}$) that is switched between a high level voltage and a low level voltage, wherein all of said voltages maintain the same fixed polarity, and wherein said reference voltage has a magnitude between magnitudes of said high and low level voltages, a control signal generator for producing a variable control voltage comprising a digital to analog converter having an input for receiving a digital to analog input code that establishes the magnitude of said variable control voltage, means for inverting said variable control voltage during alternate successive time intervals comprising means for inverting said input code, and means for combining said high and low level voltages.

4. The drive circuit of claim 3 wherein said digital to analog converter has a predetermined range ($V_{CON}$) and wherein said high level voltage is greater than said reference voltage by an amount equal to the difference between said reference voltage and the difference between said low level voltage and said predetermined range.

5. The drive circuit of claim 1 wherein said device is subject to variation in operation induced by temperature variation, and including temperature tracking means for correcting said signals for temperature variation.

6. The drive circuit of claim 5 wherein said temperature tracking means includes means for combining a temperature correction signal with each of said high and low leel voltages.

7. A method for driving an active matrix liquid crystal display device in which a drive voltage is reversed in successive time intervals to provide an average drive voltage across said device of zero, said method comprising the steps of:

establishing a fixed reference voltage and continuously applying said reference voltage to one side of the liquid crystal display device, applying to the other side of said liquid crystal display device a data signal that is switched in said successive time intervals between a first voltage that is higher than said reference voltage and a second voltage that is lower than said reference voltage, wherein said reference voltage, said first voltage and said second voltage all maintain the same fixed polarity, providing an intensity control voltage and combining said intensity control voltage with each of said first and second voltages, providing an input code to define said intensity control voltage, and inverting said input code during alternate successive time intervals.

8. A method for driving an active matrix liquid crystal display device in which a drive voltage is reversed in successive time intervals to provide an average drive voltage across said device of zero, said method comprising the step of:

establishing a fixed reference voltage and continuously applying said reference voltage to one side of the liquid crystal display device, applying to the other side of said liquid crystal display device a data signal that is switched in said successive time intervals between a first voltage that is higher than said reference voltage and a second voltage that is lower than said reference voltage, wherein said reference voltage, said first voltage and said second voltage all maintain the same fixed polarity, providing a digital to analog converter for generating an intensity control voltage, combining said intensity control voltage with each of said first and second voltages in said successive time intervals, and providing a digital intensity control code to said analog to digital converter, said step of providing a digital intensity control code including the step of inverting said code during alternate successive time intervals.

9. The method of claim 8 including the step of establishing a variation range of said digital to analog converter by applying a range control signal to said digital to analog converter and wherein said step of applying said first and second voltages comprises the step of establishing said first and second voltages at magnitudes such that the difference between said first voltage and said reference voltage is equal to the difference between said reference voltage and the difference between said second voltage and said range control signal.

* * * * *

UNITED STATES PATENT AND TRADEMARK OFFICE

CERTIFICATE OF CORRECTION

PATENT NO. : 5,604,510

DATED : February 18, 1997

INVENTOR(S) : Randall D. Blanchard

It is certified that error appears in the above-indentified patent and that said Letters Patent is hereby corrected as shown below:

Column 3, line 7: delete "throe" and insert --three--.

Column 6, line 51: delete "11,113" and insert --111,113--.

Column 7, line 21: delete "examples" and insert --example--.

Column 7, line 67: delete "30"

Column 9, Claim 6, line 20: delete "leel" and insert --level--.

Signed and Sealed this

Twenty-ninth Day of April, 1997

Bruce Lehman

*Attest:*

BRUCE LEHMAN

*Attesting Officer*

*Commissioner of Patents and Trademarks*